US005662560A

United States Patent [19]

Svendsen et al.

[11] Patent Number: 5,662,560

[45] Date of Patent: Sep. 2, 1997

[54] BILATERAL WEIGHT UNLOADING APPARATUS

[75] Inventors: Bjorn W. Svendsen, 276 Maiden La., Pleasant Lake, Mich. 49272; Jandane E. Christianson, Berrien Springs, Mich.

[73] Assignee: Bjorn W. Svendsen, Pleasant Lake, Mich.

[21] Appl. No.: 500,269

[22] Filed: Jul. 10, 1995

[51] Int. Cl.[6] ..... A63B 22/00

[52] U.S. Cl. ..... 482/69; 482/54

[58] Field of Search ..... 482/54, 69, 74, 482/71, 55, 51, 112, 66, 68, 7; 119/700, 712; 135/65, 66, 67, 68

[56] References Cited

U.S. PATENT DOCUMENTS

| | | | |
|---|---|---|---|
| 1,611,807 | 12/1926 | Bergh . | |
| 2,625,202 | 1/1953 | Richardson et al. . | |
| 3,252,704 | 5/1966 | Wilson . | |
| 3,721,437 | 3/1973 | Skaricic | 272/70.3 |
| 3,778,052 | 12/1973 | Andow et al. | 272/70.4 |
| 4,545,575 | 10/1985 | Forjot | 482/69 |
| 4,655,447 | 4/1987 | Dubrinsky et al. | 482/69 |
| 4,743,015 | 5/1988 | Marshall | 482/112 |
| 4,813,664 | 3/1989 | Vroulis | 482/68 |
| 4,861,021 | 8/1989 | Edwards et al. | 272/69 |
| 4,981,307 | 1/1991 | Walsh | 482/51 |
| 5,171,196 | 12/1992 | Lynch | 482/7 |
| 5,273,502 | 12/1993 | Kelsey et al. | 482/69 |
| 5,372,561 | 12/1994 | Lynch | 482/54 |

FOREIGN PATENT DOCUMENTS

| | | | |
|---|---|---|---|
| 2547721 | 12/1984 | France | 135/67 |

*Primary Examiner*—Stephen R. Crow
*Attorney, Agent, or Firm*—R. Tracy Crump

[57] ABSTRACT

A therapeutic bilateral weight unloading apparatus is disclosed, which suspends a user to support a selected portion of his weight while dampening both vertical and lateral forces exerted on the user during ambulation. The weight unloading apparatus includes a frame and two pivoting boom arms that are independently supported by two gas compression springs. The user is suspended between the boom arms by a body harness. The boom arms are pivotally connected to a vertically adjustable gantry frame extensibly mounted to a base frame, which allows the boom arms to be raised and lowered. Each boom arm is supported by one of the gas springs. One end of the prop is connected to a slide collar shiftably mounted to the boom arm. The slide collars can be selectively positioned along the length of the boom arms to adjust the suspension force for each boom arm.

19 Claims, 4 Drawing Sheets

10
40
42
74
44
52
50
39
38
30
46
51
48
72
45
34
69
68
64
62
60
32
36
26
2
66
67
70
25
20
23
27
4
24
22

BILATERAL WEIGHT UNLOADING APPARATUS

This invention relates to a therapeutic apparatus for suspending a user to support a selected portion of his weight while standing or exercising, and in particular, a therapeutic weight unloading apparatus, which includes two independently supported boom arms between which the user is suspended.

BACKGROUND OF INVENTION

A variety of therapeutic devices have been developed that suspend a user to support a selected portion of his weight while standing or exercising. These devices allow a user to develop strength and coordination at an earlier stage of recovery while minimizing the risk of further injury. Conventional therapeutic unloading devices include a stationary or mobile frame and a single overhanging boom arm from which the user is suspended. Typically, the boom arm is pivotally connected to the frame and supported by a suspension mechanism, such as a pneumatic or hydraulic cylinder prop, which actively or passively unloads and supports a selected portion of the user's weight.

Because the users are suspended from a single boom arm, conventional unloading devices are limited to unloading and supporting only the vertical forces exerted on the user while standing or exercising, i.e., the user's weight. When a human walks or runs (ambulation), lateral forces as well as vertical forces are generated due to the weight shifts between each leg. In many instances, an injured person has an irregular, erratic and pronounced gate, which compounds the lateral forces exerted on his body. Conventional unloading devices have not adequately compensated for the natural lateral forces exerted on a user during ambulation. Because the lateral forces are not dampened or reduced by the unloading device, the suspended user counter acts the lateral forces using his own strength and coordination. Ideally, an unloading device should reduce a selected portion of the lateral forces exerted on a suspended user as well as unloading and supporting a selected portion of the user's weight.

SUMMARY OF INVENTION

The therapeutic bilateral weight unloading apparatus of this invention suspends a user to support a selected portion of his weight while reducing and dampening both vertical and lateral forces that are exerted on the user while standing or exercising. The apparatus of this invention suspends the user between two independently supported boom arms. The independent action of the boom arms gently counter balances the user's natural weight shifts to reduce and dampen both the vertical and lateral forces exerted on the suspended user while standing or exercising.

The unloading apparatus includes a frame and two pivoting boom arms that are independently supported by two gas compression springs. The user is suspended between the boom arms by a body harness. The boom arms are pivotally connected to a vertically adjustable gantry frame extensibly mounted to a base frame, which allows the boom arms to be raised and lowered. The gas springs provide the upward suspension force used to support a selected portion of the user's weight. One end of the gas springs is connected to a slide collar shiftably mounted to each of the boom arms. Each slide collar can be selectively positioned along the length of the boom arm to adjust the suspension force for each boom arm. In addition, the base frame may be fitted with casters, which allows the apparatus to be moved by the suspended user.

Accordingly, an advantage of the unloading apparatus of this invention is that the apparatus unloads a selected portion of the user's weight while dampening both vertical and lateral forces exerted on the user during ambulation.

Another advantage of the unloading apparatus of this invention is that the apparatus includes two independently supported boom arms.

Another advantage of the unloading apparatus of this invention is that each boom arm is independently supported by a gas spring connected to a slide collar shiftably mounted to the boom arm, and that the upward suspension force on each boom arm can be adjusted by changing the position of the slide collar along the length of the boom arm.

Another advantage of the unloading apparatus of this invention is that the boom arms are connected to a gantry frame, which can be raised and lowered to adjust the height of the boom arms.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

The preferred embodiments herein described are not intended to be exhaustive or to limit the invention to the precise form disclosed. They are chosen and described to explain the invention so that others skilled in the art might utilize its teachings.

Figure 1:
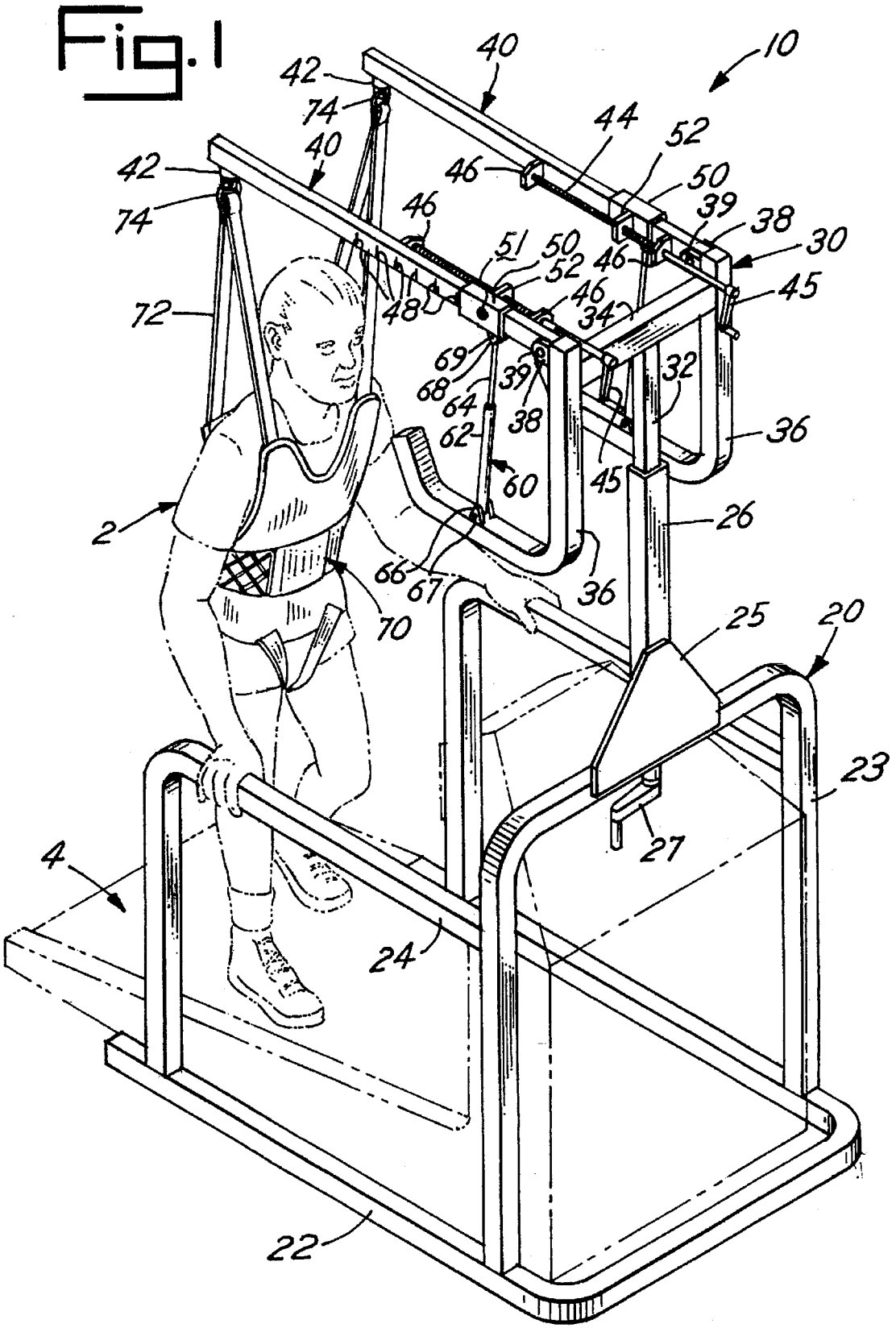
FIG. 1 is a perspective view of the bilateral weight unloading apparatus of this invention used with a conventional tread mill.

FIG. 1 shows one embodiment of the bilateral weight unloading apparatus 10 of this invention. Apparatus 10 includes a base frame 20, a vertically extensible gantry frame 30, two independent boom arms 40, gas compression springs 60 and a body harness 70. Base frame 20 includes a U-shaped horizontal member 22 and a U-shaped vertical member 23 connected perpendicularly to horizontal member 22. Two L-shaped handrails 24 are connected to the adjacent legs of U-shaped members 22, 23. Handrails 24 allow a user to support himself while standing, walking, running or engaging in other exercise. A tubular upright member 26 extends upwardly from the center of U-shaped member 23. Upright member 26 is supported by a gusset 25. As shown, the configuration of base frame 20 allows apparatus 10 to be positioned over a conventional tread mill 4.

Figure 2:
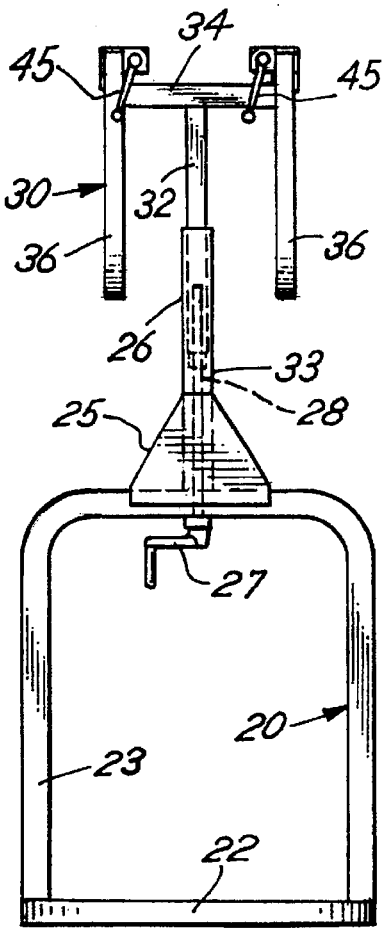
FIG. 2 is a front view of the bilateral weight unloading apparatus.
Figure 3:
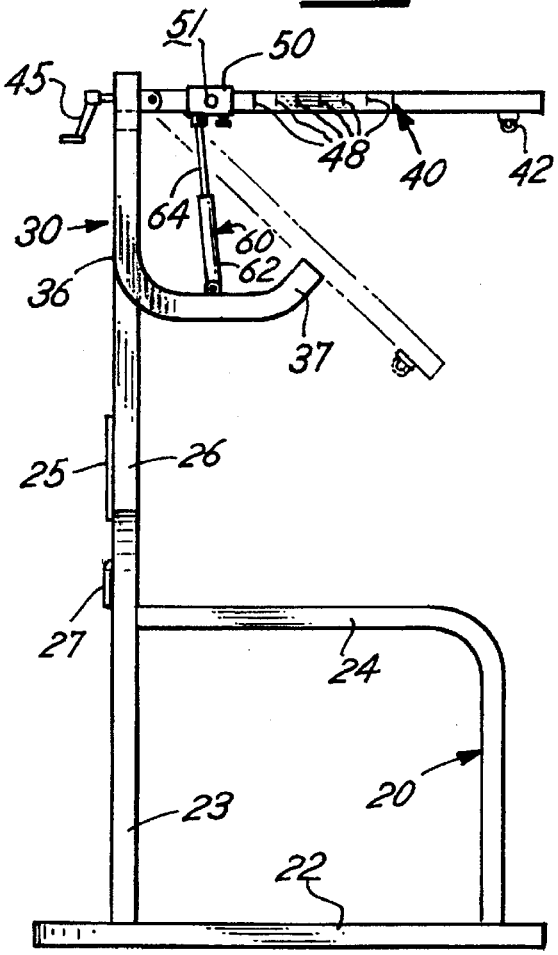
FIG. 3 is a side view of the bilateral weight unloading apparatus.
Figure 4:
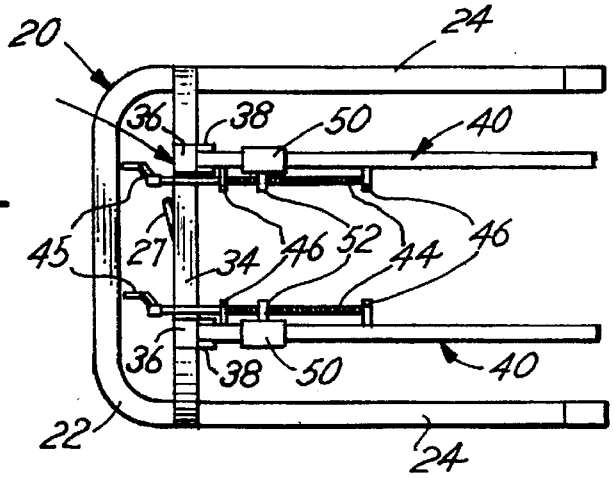
FIG. 4 is a top view of the bilateral weight unloading apparatus.

Gantry frame 30 includes a tubular neck 32, a horizontal cross member 34 and two J-shaped side arms 36. Neck 32 is extensibly disposed within the upper end of upright member 26 to support carriage 30 above base frame 20. As shown in FIG. 2, neck 32 includes a block 33 secured to its disposed end and having a threaded bore. Base frame 20 also includes a hand crank 27 connected to a screw shaft 28, which is turned into the threaded bore of block 33 and extends longitudinally through upright member 26 and neck 32. Rotating screw shaft 28 extends and retracts neck 32 from upright member 26 to raise and lower carriage 30 above base frame 20. For convenient operation, screw shaft 28 may be driven by a motor (not shown). Cross member 34 is connected perpendicularly atop neck 32. The upright portions of side arms 36 are connected at opposite ends of cross member 34, so that the lower horizontal portions of each arm 36 extend rearward. Each side arm 36 has an upturned distal end 37, which acts as a safety stop for boom arms 40 as best shown in FIG. 3.

Figure 5:
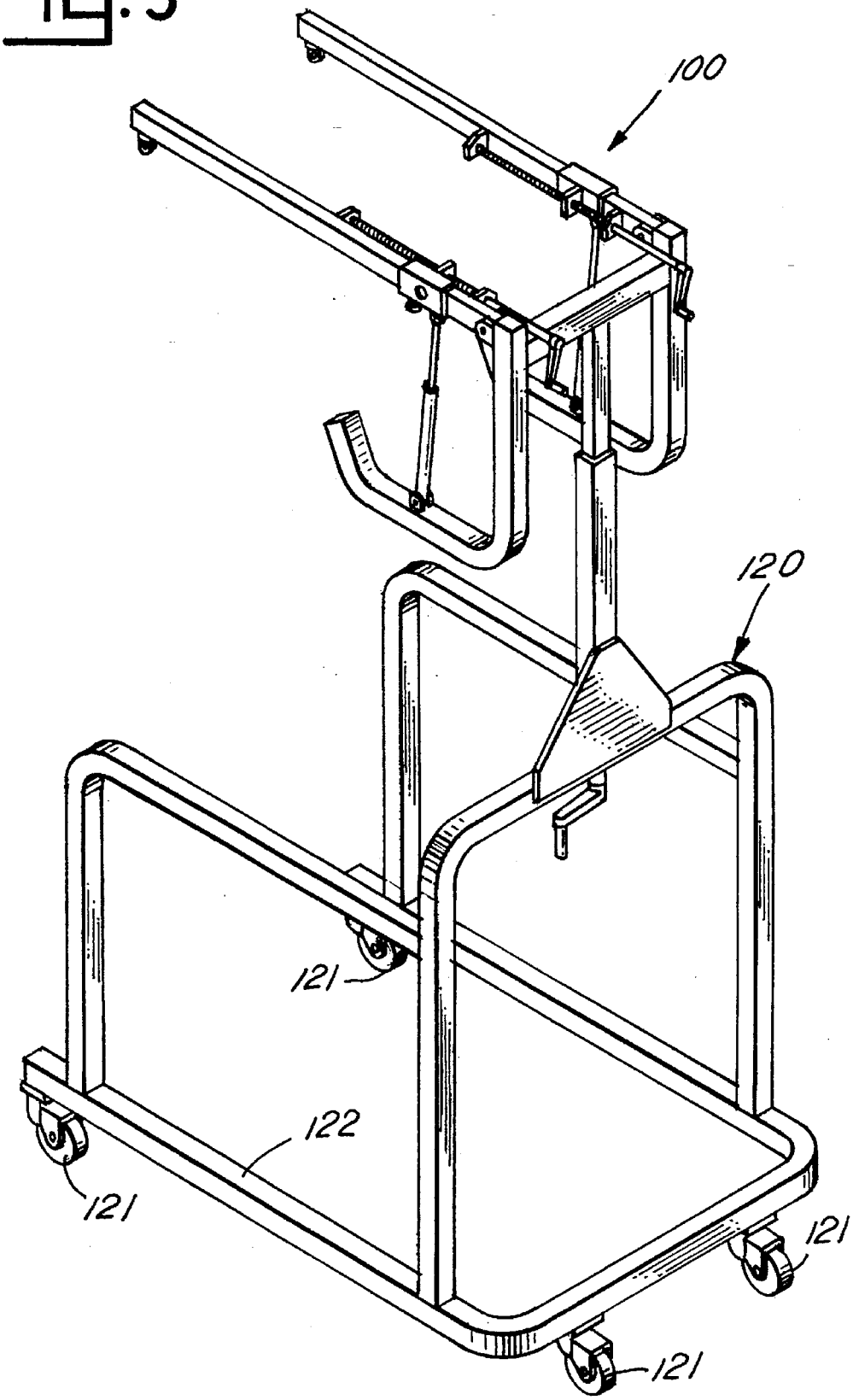
FIG. 5 is a perspective view of a second embodiment of the bilateral weight unloading apparatus including casters.

Boom arms 40 are pivotally connected to the upper end of side arms 36 by a bifurcated bracket 38 and a pivot pin 39. Each boom arm 40 includes a shiftable slide collar 50 and rotatable lead screw 44 which is used to selectively position slide collars 50 along the length of the boom arms. Lead screws 44 are rotatably mounted parallel to the boom arms by four journal boxes 46. Slide collars 50 are operatively connected to lead screws 44 by collar brackets 52. Each collar bracket 52 has a threaded bore through which a lead screw 44 passes. A crank handle 45 is connected to the end of lead screws 44. Rotation of lead screws 44 cause slide collars 50 to move longitudinally along boom arms 40. The lead screws may be rotated by a drive motor (not shown) for convenient operation. In addition, lead screws 44 can be connected by a linkage mechanism (not shown) to provide simultaneous rotation of both lead screws and thereby simultaneous movement of the slide collars, Boom arms 40 are pivotally connected to gantry frame 30 and independently supported by two conventional gas compression springs 60 to allow suspended movement in two parallel vertical planes. Preferably, gas springs 60 have a constant or linear compression and expansion force. While gas springs 60 are illustrated herein, any suitable suspension mechanism may be employed. Each gas spring 60 includes a cylinder casing 62 and an extensible piston rod 64. Cylinder casings 62 are pivotally connected to the horizontal portions of side arms 36 by a bifurcated bracket 66 and a pivot pin 67. Piston rod 64 is pivotally connected to slide collar 50 by a bifurcated bracket 68 and a pivot pin 69. Each gas spring 60 imparts a constant upward suspension force on its boom arm 40, which is used to support a portion of the user's weight. The upward suspension force on each boom arm can be adjusted by moving slide collars along the length of boom arms 40. The suspension force of gas spring 60 decreases as slide collars 50 are moved toward the distal end of boom arms 40. As shown in FIG. 5, boom arms 40 may be marked with a series of indicia 48 corresponding to each discrete location of slide collars 50. Preferably, each indicia mark 48 indicates the upward force on the boom arm 40 at its distal end. Each slide collar 50 has a window 51 through which indicia 48 can be readily viewed.

As shown in FIG. 1, the user 2 is suspended between the distal ends of boom arms 40 by a body harness 70 worn by the user. Each boom arm includes a harness mounting hook 42. Body harness 70 has a conventional design and is adapted to be worn by the patient about the patient's groin, legs and torso. Harness 70 includes two pairs of shoulder straps 72. Each pair of shoulder straps 72 includes a D-ring 74, which is hooked to mounting hooks 42 on boom arms 40.

In use as seen in FIG. 1, unloading apparatus 10 may be used alone or with a conventional tread mill 4 or other type of ambulatory exercise device. As shown in FIG. 1, members 22 and 23 of base frame 20 allow tread mill 4 to be positioned directly under the suspended user 2. Initially, slide collars 50 are positioned along the length of boom arms 40 to provide the desired suspension force for the user 2. Next, user 2 is fitted with body harness 70. Once fitted with body harness 70, user 2 assumes a position on tread mill 4 under boom arms 40, so that shoulder straps 72 can be secured to their respective boom arms 40. User 2 may require assistance in attaching shoulder straps 72 to mounting hook 42. Gantry frame 30 may be lowered to facilitate the connection of the shoulder straps to the boom arms. Once the body harness is connected between the boom arms, gantry frame 30 is raised, which spaces boom arms 40 above user 2 to provide the user with the appropriate support at a suitable height for the user to stand naturally. Now, the user is free to stand and exercise under his own power, but balancing and bearing only a selected portion of his own weight. During use, the independent actuation of the laterally spaced boom arms and the suspension force imparted by gas springs 60 gently counter balance the user's natural weight shifts to reduce and dampen both the vertical and lateral forces exerted on the user while standing or exercising.

Figure 6:
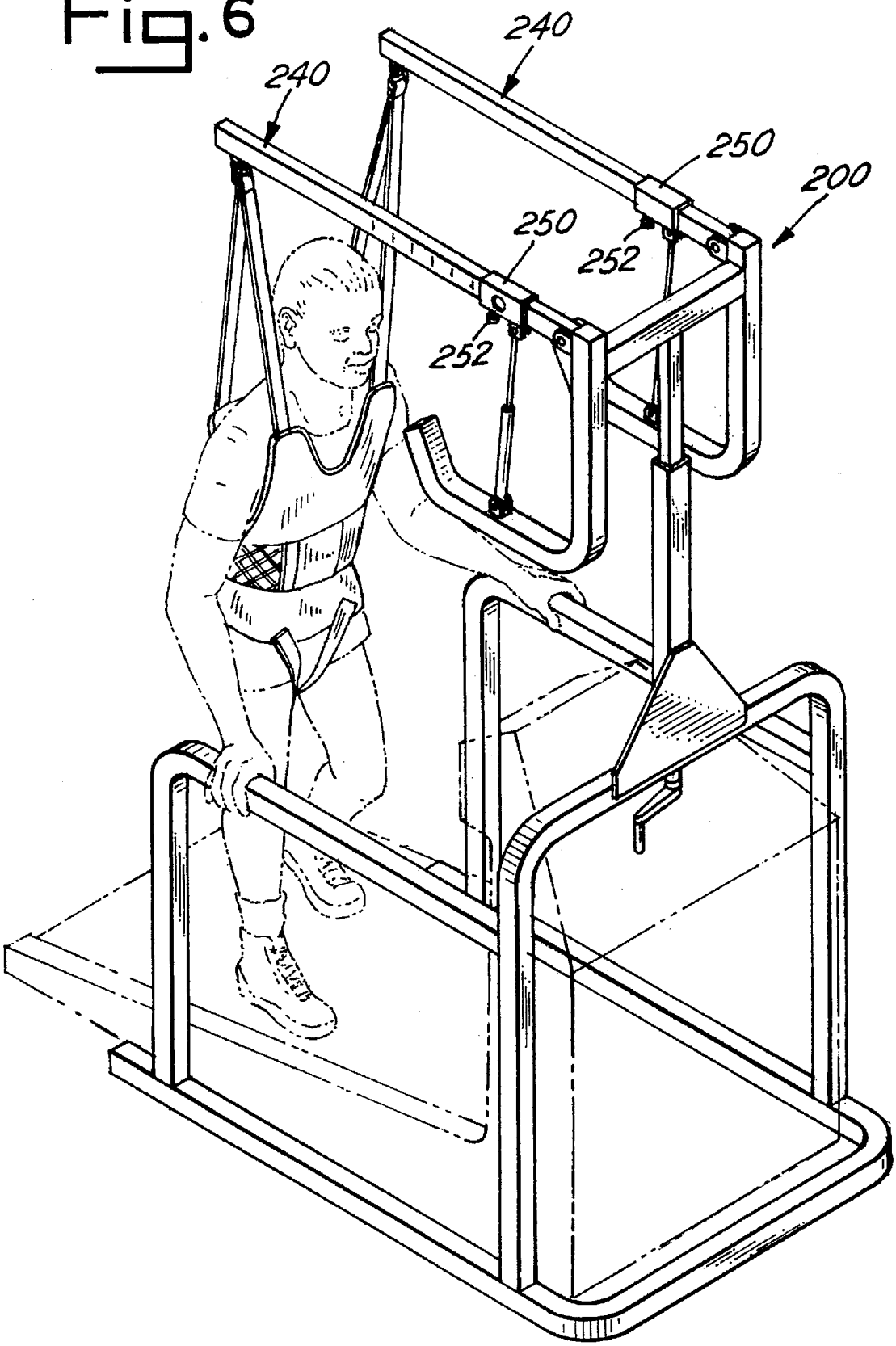
FIG. 6 is a perspective view of a third embodiment of the bilateral weight unloading apparatus.

FIGS. 5 and 6 show two additional embodiments of the unloading apparatus of this invention, FIG. 5 shows an unloading apparatus 100, which is moveable by the suspended user. As shown, base frame 120 includes lockable casters 121 mounted to horizontal U-shaped member 122. Casters 121 allows the suspended user to move the apparatus while having a portion of his weight supported. FIG. 6 shows an unloading apparatus 200 which includes a manually movable slide collar 250. The under sides of each boom arm 240 have a plurality of bores (not shown). Slide collars 250 include a locking snap pin mechanism 252, which allows slide collars 250 to be secured at selected locations along boom arms 240. The snap pin mechanism 252 includes an extensible pin (not shown) for protruding into one of the bores in boom arms 240 to secure slide collars 250 in place.

It is understood that the above description does not limit the invention to the details given, but may be modified within the scope of the following claims.

We claim:

1. A therapeutic weight unloading apparatus for suspending a user to support a portion of the weight of said user while standing or exercising, comprising:

a frame, two boom arms independently pivotally connected to said frame and laterally spaced from each other, a body harness to be worn by said user and connectable between said boom arms for suspending said user therebetween, and means connected between said frame and each said boom arm for imparting an upward force on each said boom arm to independently support each said boom arm, whereby said boom arms support said portion of weight when said user is suspended between said boom arms.

2. The apparatus of claim 1 wherein each said boom arm includes means for selectively varying the upward force imparted to that said boom arm by said connected force imparting means, whereby said portion of the weight supported between said boom when said user is suspended is selectively varied.

3. The apparatus of claim 2 wherein said force varying means of each said boom arm includes a collar part shiftably mounted to said boom arm and connected to said force imparting means, and means for positioning said collar part between a plurality of discrete locations along the length of said boom arm.

4. The apparatus of claim 3 wherein said positioning means includes a rotatable lead screw mounted parallel to said boom arm and operatively connected to said collar part, whereby rotation of said lead screw moves said collar part along the length of said boom arm.

5. The apparatus of claim 2 wherein said force varying means includes a collar part shiftably mounted to said boom arm and connected to said force imparting means, and means for securing said collar part between a plurality of discrete positions along the length of said boom arm.

6. The apparatus of claim 1 wherein said frame includes a base part, a gantry part extensibly connected atop said base part, and means connecting said gantry part atop said base part for raising and lowering said gantry part above said base part.

7. The apparatus of claim 6 wherein said boom arms are pivotally connected to said gantry part.

8. The apparatus of claim 6 wherein said connecting means includes a tubular upright member rising from said base part and having an open upper end, and a tubular neck part connected to said gantry part and extensibly disposed within said upper end of said upright member and having a threaded female part, and a rotatable screw shaft journaled within said upright member and mated to said neck female part whereby rotation of said screw shaft extends and retracts said neck part from said upright member to raise and lower said gantry part above said base part.

9. The apparatus of claim 6 wherein said gantry frame includes two laterally spaced side arms, one of said boom arms being pivotally connected to each said side arms, and one of said force imparting means being pivotally connected between the connected said side arms and said boom arms.

10. The apparatus of claim 9 wherein each said side arm include stops means for engaging said boom arms to prevent said user from falling while using said apparatus.

11. The apparatus of claim 1 wherein said frame includes caster means for permitting movement of said apparatus.

12. The apparatus of claim 1 wherein said force imparting means includes a gas compression spring.

13. A therapeutic weight unloading apparatus for suspending a user to support a portion of the weight of said user while standing or exercising, comprising:

a frame, two boom arms independently pivotally connected to said frame and laterally spaced from each other, a body harness to be worn by said user and connectable to said boom arms for suspending said user between said boom arms, and means connected between said frame and each said boom arm for imparting an upward force on each said boom arm to independently support each said boom arm, whereby said boom arms support said portion of weight when said user is suspended between said boom arms.

14. The apparatus of claim 13 wherein each said boom arm includes a collar part shiftably mounted to said boom arm and a rotatable lead screw mounted parallel to that said boom arm and operatively connected to said collar part, whereby rotational movement of said lead screws moves said collar parts along the length of said boom arms, one of said force imparting means being connected to each said collar part.

15. The apparatus of claim 13 wherein said frame includes a base part, a gantry part extensibly connected atop said base part, said boom arms being pivotally connected to said gantry part, said base part including a tubular upright member having an open upper end, said gantry part including a tubular neck part extensibly disposed within said upper end of said upright member and having a threaded female part, and a rotatable screw shaft journaled within said upright member and mated to said neck female part whereby rotation of said screw shaft extends and retracts said neck part from said upright member to raise and lower said gantry part above said base part.

16. The apparatus of claim 15 wherein said gantry frame includes two laterally spaced side arms, one of said boom arms being pivotally connected to each said side arm, and one of said force imparting means being pivotally connected between said connected side arms and boom arms.

17. The apparatus of claim 17 wherein each said side arm includes stop means for engaging said boom arms to prevent said user from falling while using said apparatus.

18. The apparatus of claim 13 wherein said frame includes caster means for permitting movement of said apparatus.

19. The apparatus of claim 13 wherein said force imparting means includes a gas compression spring.

* * * * *